US009726000B2

(12) United States Patent
Owens

(10) Patent No.: US 9,726,000 B2
(45) Date of Patent: Aug. 8, 2017

(54) PULSED FRACTURING METHOD AND APPARATUS

(71) Applicant: WEST VIRGINIA HIGH TECHNOLOGY CONSORTIUM FOUNDATION, Fairmont, WV (US)

(72) Inventor: Thomas L. Owens, Fairmont, WV (US)

(73) Assignee: WEST VIRGINIA HIGH TECHNOLOGY CONSORTIUM FOUNDATION, Fairmont, WV (US)

( * ) Notice: Subject to any disclaimer, the term of this patent is extended or adjusted under 35 U.S.C. 154(b) by 280 days.

(21) Appl. No.: 14/530,257

(22) Filed: Oct. 31, 2014

(65) Prior Publication Data

US 2015/0114623 A1 Apr. 30, 2015

Related U.S. Application Data

(60) Provisional application No. 61/942,171, filed on Feb. 20, 2014, provisional application No. 61/916,244, filed on Dec. 15, 2013, provisional application No. 61/898,294, filed on Oct. 31, 2013.

(51) Int. Cl.
*E21B 43/26* (2006.01)
*E21B 43/24* (2006.01)

(52) U.S. Cl.
CPC ..... *E21B 43/2405* (2013.01); *E21B 43/26* (2013.01)

(58) Field of Classification Search
CPC .... E21B 43/2405; E21B 43/26; E21B 43/263; E21B 43/2635
See application file for complete search history.

(56) References Cited

U.S. PATENT DOCUMENTS 5,018,590 A * 5/1991 Weldon ..... E21B 4/12 175/105
2009/0294121 A1* 12/2009 Leon ..... E21B 43/26 166/248
2013/0255936 A1* 10/2013 Geilikman ..... E21B 43/26 166/248
2014/0262227 A1* 9/2014 Storslett ..... E21B 43/26 166/248

* cited by examiner

*Primary Examiner* — Brad Harcourt
(74) *Attorney, Agent, or Firm* — Birch, Stewart, Kolasch & Birch, LLP

(57) ABSTRACT

The branching of fractures in shale formations surrounding a wellbore can be enhanced so that more rock surface is exposed in the formation and more hydrocarbon resources can be recovered using smaller quantities of fracturing fluids. The branching of the fractures can be enhanced by establishing a substantially static sub-threshold fluid pressure in a well in a geological formation, and generating a pressure pulse in the well such that the pressure pulse combined with the substantially static sub-threshold fluid pressure forms a plurality of fractures in the geological formation. An arc jet insertable into a passage in the geological formation and having an electric arc channel can be used to generate the pressure pulse.

16 Claims, 6 Drawing Sheets

PULSED FRACTURING METHOD AND APPARATUS

CROSS REFERENCE TO RELATED APPLICATIONS

This application claims the benefit of U.S. provisional application Ser. Nos. 61/898,294 filed Oct. 31, 2013; 61/916,244 filed Dec. 15, 2013; and 61/942,171 filed Feb. 20, 2014.

FIELD OF INVENTION

This application relates to oil and natural gas production from underground wells. More specifically, the application relates to a method and apparatus for increasing the branching of fractures in shale formations surrounding a wellbore so that more rock surface is exposed in the formation and more hydrocarbon resources can be recovered using smaller quantities of fracturing fluids.

BACKGROUND

The present invention discloses a device for fracturing rock and stimulating production in an oil or gas well using pulses of pressure released within the confines of a wellbore. A specific method is presented for generating multiple pulses of pressure in succession at one location using multiple electric arc discharges. It is well-known that pulses of pressure can produce increased fracture branching and fracture density, but fractures tend to be relatively short in prior methods. The present invention adds the step of applying a static background pressure to hold open the fractures so that pulses can be applied multiple times to lengthen the fractures and increase the reach into the formation. The use of an electric arc device enables this added step. Greater surface exposure of hydrocarbon-bearing rock in the target formation results, which, in turn, leads to more complete drainage of hydrocarbons. In addition, the fractures can be better confined within the formation resulting in reduced fluid filling of the fractures relative to the hydrocarbons produced.

To illustrate the problem and the technical need, FIG. 1 shows data on the extent of hydraulic fracturing in the vertical direction for nearly four hundred hydraulic fracture treatments in the Marcellus shale in the Appalachian Basin of Ohio, Pennsylvania, and West Virginia. Many of the hydraulic fractures extend 1000 ft. in the vertical direction, with a few fractures extending nearly 2000 ft. A similar trend is found in hydraulic treatments in the Barnet Shale in the Fort Worth Basin in Texas, with average vertical fracture lengths somewhat less than those produced in the Marcellus shale.

While hydraulic fracture lengths up to 2,000 feet long are generated in the Marcellus, the Marcellus stratum itself is less than 100 ft. thick over most of West Virginia, Ohio, and Western Pennsylvania. In this circumstance, most of the fracture volume extends far outside of the production zone into unproductive strata, resulting in inefficient use of hydraulic fluids. In addition, wide spaces exist between fractures resulting in incomplete drainage of hydrocarbons in the target formation. There is a need for an improved stimulation method that maintains more fractures closer to the production zone where increased fracture surface in the target formation will emit more gas from the rock strata and less hydraulic fluid will be required for a given production level. Reduced fracturing fluid volumes will improve process efficiencies and simplify environmental management of flowback fluids at the surface of the well. Better fracture containment closer to the production layer will also help ease public concerns that long uncontrolled hydraulic fractures in conventional methods that may inadvertently intersect abandoned wells or natural faults in rock layers above the Marcellus, compromising the thick rock barriers that normally prevent the vertical migration of hydraulic fracturing fluids into drinking water aquifers. Higher fracture density in the target formation will improve the drainage of hydrocarbons from the formation.

In related prior art, Gas Propellant Fracturing (GPF) has been shown to generate increased fracture density using pulses of pressure and the method is sometimes used to stimulate wells. The GPF technique is occasionally referred to by various other names including Tailored Gas Pulse Fracturing, Controlled Pulse Fracturing, and Low-Explosive Well Stimulation. GPF applies a large impulsive force to the rock formation around the wellbore. In GPF methods, impulsive forces are produced by relatively slow-burning chemical mixtures that are considered deflagrants rather than explosives. Typical burn times are on the order of tens of milliseconds. Suitable burn times and pressure profiles must be maintained in order to fracture rock effectively. Pressures applied too quickly compress the rock, making it less permeable. Pressures applied too slowly lead to bi-wing fractures that generate limited flow to the wellbore. Intermediate impulse periods produce the best stimulation results with fractures in many directions, not just in vertical planes perpendicular to the direction of least compression in the rock formation. More extensive fracture branching is produced when properly tailored pressure pulses are applied, resulting in increased flow and increased resource recovery near the wellbore.

The pulsed electric discharges in the present invention provide an electromagnetic improvement of the GPF detonations. Unlike GPF methods, the proposed electric-discharge method can provide precise electronic control of the all-important pulse-duration and pulse-profile, yielding optimal fracturing under variable conditions in the formation. Discharge-induced pressures can be programmed on a pulse-by-pulse basis to accommodate highly variable rock properties near the wellbore.

Another major limitation of GPF methods is that the deflagrant is consumed after each shot, so that GPF devices must be replaced between shots. In contrast, electric pulses powered from the surface of the well as taught in the present invention can be fired repeatedly without removing the arc-source from the well. The arc-source can remain in the wellbore until the entire well has been treated and it can be fired repeatedly at one location. In firing multiple discharges at one location, static or quasi-static bias pressure helps to hold open the fracture channels so that superimposed transient pressure surges applied repeatedly at one location in the wellbore can better expand the fracture network and extend fractures greater distances from the wellbore than GPF methods, which already produce fractures up to about 50 feet from the wellbore in a single discharge.

To help understand the basic premise that pulsed pressures will induce highly branched fractures, a circuit analog of a pulsed hydraulic fracturing scenario is provided in FIG. 3. The analog is based upon correspondences that can be drawn between fluid parameters for pulsed hydraulic fracturing and electrical parameters for a discrete-element circuit. These correspondences are tabulated in Table I.

TABLE I

Electrical parameters and analogous fluid parameters in the circuit analog used to help understand how increased fracture branching can occur in response to pulsed

| ELECTRICAL CIRCUIT | ANALOGOUS FLUID PARAMETER |
|---|---|
| Voltage | Pressure |
| Electrical Current | Fluid Flow Rate |
| Ohmic Resistance | Flow Resistance to Static Pressure |
| Inductance | Fluid and Rock Inertia |

The circuit example contains three circuit branches coming off of the main circuit branch, analogous to three small fluid-filled fractures extending from various points along a principal fracture. The overall length of the principal fracture is denoted by the parameter L in the figure caption. In this example, resistance-per-unit-length of the side branches is a factor of ten higher than the resistance-per-unit-length of the principal branch, modeling a situation in which the side fractures have relatively high resistance to fluid flow due to smaller initial cross sections compared to the principal fracture.

FIG. 4 shows the voltage differences, analogous to pressure differentials, across the various branches of the circuit. The colors of the curves in FIG. 4 correspond to the colors of probe pairs in FIG. 3. Each pair of probes measures a voltage difference between the probe locations. FIG. 4 indicates that the highest voltage difference and, by analogy, the highest pressure differential occurs in the side branch nearest the transient source that drives the system. Transient voltages, and therefore transient pressures, fall off away from the drive source with very little drive remaining at the end of the principal branch. Interpreting these results in terms of analogous fluid parameters, the substantially higher "pressures" developed near the "pressure source" at the root of the "principal fracture" will tend to create multiple fractures near the root of principal fracture in preference to extending the length of the principal fracture which has much lower transient "pressure" at its extremity, illustrating the general premise of the invention.

SUMMARY OF INVENTION

The present invention overcomes the shortcomings of conventional hydraulic fracturing by providing a more efficient system for completion and stimulation of oil and natural gas wells in shale formations by fracturing rock using multiple pulses of pressure applied simultaneously with a quasi-static bias pressure.

An aspect of the invention is a method for fracturing a subterranean geological formation, including (i) establishing a substantially static fluid pressure in a well in the geological formation, wherein the substantially static pressure is less than a threshold pressure that fractures the geological formation; and (ii) generating a pressure pulse in the well such that the pressure pulse combined with the substantially static pressure forms a plurality of fractures in the geological formation.

A second aspect of the invention is a method for fracturing a subterranean geological formation, including (i) establishing a sub-threshold substantially static fluid pressure in a well in the geological formation; and (ii) generating a pressure pulse in the well such that the pressure pulse combined with the substantially static pressure forms a plurality of fractures in the geological formation, wherein the pressure pulse is generated by an arc source such as an arc jet.

A third aspect of the invention is an apparatus for fracturing a subterranean geological formation from a passage extending through the geological formation, including an arc jet insertable into the passage and having an electric arc channel, wherein the arc channel contains a fluid; a pulsed electrical power supply in communication with the arc jet; and means for transmitting electrical energy from the pulsed electrical power supply to the arc jet, wherein the pulsed electrical power supply transmits electrical energy to the arc jet to generate an electric arc in the fluid in the arc channel thereby generating a pressure pulse for generating a plurality of fractures in the geological formation.

To help ease public concerns over the considerable vertical distances that conventional hydraulic fractures can propagate and to help reduce the volumes of hydraulic fluids required to induce a given gas output, the present invention provides an alternative to conventional hydraulic fracturing that provides improved resource recovery and reduced environmental impact. The method superimposes numerous short surges of high pressure at depth within the well on top of a static or quasi-static bias pressure as a first stage of fracturing in uncased or cased-and-perforated wells. The bias pressure brings the formation to the brink of fracturing. Geologic response to dynamic pressure surges at this point leads to fracture formulation in many directions, not just in the usual bi-wing fracture planes, resulting in greater fracture branching and increased rock exposure. Bias pressure holds open the fractures during repeated pressure surges and helps extend the fracture network after fracture initiation.

Proppant is not required during this treatment since the fractures are held open by the bias pressure. Once a highly-branched fracture network has been established using biased pressure surges, the wellbore can be cleared of equipment and standard hydraulic fracturing can be applied in the conventional manner using increased bias pressure to extend and enlarge the initial fractures. Proppant can be added in this final stage to hold open the fractures after hydraulic pressure is removed.

Pressure surges can be applied using a pulsed electric discharge in the wellbore near the fracture sites, while static or quasi-static bias pressure is applied by standard hydraulic equipment at the surface of the well. Since the system uses pulsed electrical discharges only, no hazardous toxic chemicals are injected into the well from the system. In response to transient pressure surges, the inertia of fluids in the formation resists the extension of long fractures. The heavier mass of fluid and rock in long fractures tends to resist movement when the fluid mass is driven by a transient pressure surge. The result is that transient pressure will build up near the root of long fractures rather than at the far end of the fractures. New fractures will form near the fracture root in preference to the extension of long fractures. The process creates an extensive network of highly branched fractures in the production zone that expand in all directions, not just in the principal vertical planes, as in conventional hydraulic fracturing. The fracture network can be enlarged and extended by applying pulses repeatedly at a fixed location in the wellbore. Bias pressures hold open the fractures to increase the reach and effectiveness of multiple pulse discharges.

In one embodiment, after biased pressure surges have extended the fracture network sufficiently, conventional hydraulic fracturing can be applied by itself to lengthen the new network of fractures to a desired level and to finalize the fracture network. In this embodiment, the biased pulsed fracturing process provides a pre-treatment option that creates highly branched extensions of the wellbore, from which more extensive hydraulic fracturing can be performed that covers much more of the production zone and recovers a far greater fraction of the resource.

Because of the higher density of fractures created by pulsed fracturing, individual fracture lengths can be shorter than fracture lengths required in conventional hydraulic fracturing. The larger surface exposure of fractured rock resulting from increased fracture branching compensates for reduced fracture length. Follow-on hydraulic fracturing with proppant is used largely to inject proppant into existing fractures created by the pulsed system, while most of the primary fractures are created by pulsed pressure applied once or multiple times at each wellbore location. With increased fracture branching and associated fracture density, hydrocarbons can be retrieved more completely from the productive shale to maintain high production levels with minimal fluid use. With shorter and more controlled fractures, gas and oil operations are less likely to jeopardize drinking water aquifers. Reduced fluid use will facilitate environmental management of flowback fluids and help reduce the overall environmental impact of oil and gas operations.

The biased-pulse fracturing method can also be used in conjunction with waterless fracturing fluids that offer advanced alternatives in the industry. For example, the pulsed fracturing method can be used in conjunction with liquid or supercritical carbon dioxide fluids that can replace water usage in some hydraulic fracturing operations. The lower fracture volume relative to gas as a result of the invention reduces the cost of expensive waterless fluids. In addition, pressure surges applied in the invention help disperse proppants at depth in waterless fluids, helping to alleviate an important issue associated with poor proppant dispersion in waterless fluids because of their low viscosities. The use of supercritical or liquid carbon dioxide in waterless fracturing provides a beneficial application for copious amounts of carbon dioxide generated in fossil-fueled power plants. When the wells are ultimately capped, the fracture sites become sequestration sites for carbon dioxide.

The pulsed fracturing method of the invention can be used not only during the completion process for new wells, but the method has unique advantages for the stimulation of older wells that have reached the point of diminishing returns using conventional stimulation methods. For these older wells, the pulsed fracturing process opens up fracture branches into new rock within the production layer, rather than merely lengthening existing fractures that have diminished productivity. The result is new life for older wells that could not be achieved using traditional hydraulic fracturing methods.

Because pulsed fracturing methods generate many more fracture branches in more directions than traditional hydraulic methods, the biased pulse method of the invention will produce a more extensive network of initial fractures that can be subsequently extended and expanded using conventional hydraulic fracturing methods if desired. With improved fracture coverage and increased exposure of rock surfaces, a larger fraction of hydrocarbons can be retrieved, resulting in increased hydrocarbon production from available reserves in the ground.

The pulsed stimulation method of the invention offers a means of reducing the volumes of fracturing fluids required for a given gas production level. Reduced fracturing fluid volumes will facilitate environmental management and help reduce the possibility of accidental releases of flow-back fluids into the environment. Reduced truck traffic for hauling fluids will also mitigate disruptions and road damage in local communities. Well-controlled and tightly-contained fractures generated by the invention will be far less likely to intersect natural or man-made conduits to potable water aquifers near the surface, easing public concern over this issue as well.

Biased-pulse fracturing can benefit both large producers and small producers. The method is not restricted to particular localities or geological formations. It can be applied to vertical wells or horizontal wells. It can be used to initiate fractures in very dense rock that is difficult to fracture using conventional hydraulic fracturing. In addition to well stimulation, the method can be used to increase flow paths into a formation at injection wells. In this case, a more extensive fracture branching will allow greater sweeping of formation fluids toward a production well. For injection wells used for fluid disposal, the invention can reduce flow constrictions near the wellbore, increasing fluid flow into the formation for a given head pressure. In a similar manner, flow constrictions near the wellbore of certain types of production wells can be alleviated.

The biased pulse method of the present invention has several advantages over gas propellant methods that also produce branched fracturing from pulsed pressures. For example, the biased pulse method using electric arc discharges has reduced costs as a result of lower operating expenses per well and the distribution of initial equipment costs over thousands of wells made possible by long equipment lifetimes.

Unlike GPF methods, the pulsed electric system of the present invention has precise and variable control of pulse duration and pulse energy tailored to the particular formation properties.

The electric arc-source of in one of the embodiments of the invention does not need to be removed from the well between shots. It can remain in the well and fired repeatedly until the entire well has been pre-treated.

There is no debris or foreign material left in the well after firing the arc-source of the present invention.

There are no issues with handling or transporting chemical deflagrants, and no concerns about premature ignition at high temperatures in the well.

Since quasi-static hydraulic pressure can be applied in the background as the arc-source is fired repeatedly, the effect of the pressure pulse is enhanced and more extended fractures are generated with increased branching.

Energies in the biased pulse method can exceed those applied using GPF methods, since the power source for the discharge can be placed at the surface where there are no fundamental limitations on space or power.

The pulsed stimulation approach differs most substantially from GPF methods in its use of electrical energy to generate pulses and in the addition of static background pressure of several thousand psi to open up fractures for subsequent pressure surges and to bring the reservoir close to the point of fracturing prior to firing pulses repetitively in the formation. The addition of background pressure greatly enhances the effect of a given pulse energy and facilitates fracture expansion and extension.

BRIEF DESCRIPTION OF THE DRAWINGS

The present invention is described with reference to the accompanying drawings. In the drawings, like reference numbers indicate identical or functionally similar elements. The left-most digit(s) of a reference number identifies the drawing in which the reference number first appears.

DETAILED DESCRIPTION

The invention will use reduced fluid volumes for a given production level and will recover a larger fraction of hydrocarbon resources from shale formations. By reducing fluid volumes and associated chemical additive volumes, fracturing fluids may be better managed to help protect the environment. In particular the risk of accidental release of contaminated flowback fluids into the environment is greatly diminished. With lower fluid volumes, fewer trucks will be needed to haul fluids, reducing transport costs for producers, and minimizing disturbances and road damage in local communities. By containing stimulation fractures closer to the production zone, the chances of intersecting abandoned wells and vertical faults is decreased, easing public concerns that these pathways or other undetected pathways could provide conduits to potable water aquifers near the surface.

Electric Discharge Apparatus

Pulsed pressures can be applied in the shale formation by means of powerful electric discharges in the fracture fluid near the fracture site. Pulses of electric energy can be transmitted to a compact arc-source located in a perforated section of a wellbore, or the uncased portion of some wells. During the electric discharges, a plasma forms at the arc-source, sending a high pressure surge into the formation with sufficient force to fracture rock. The arc-source is submerged in a column of fluid within the well that provides back pressure to tamp the impulsive force of the pressure surge and channel the surge into the formation with considerable force. Electric pulse energy is supplied by a capacitor bank charged by a generator located at the surface of the well. Other pulsed energy sources may be used, including compulsators, flywheel systems, and other well-known pulsed power sources. The electric pulse of energy is transmitted to the arc-source at high-voltages using an electric cable connected between the pulsed power supply on the surface and the arc-source at depth in the well.

Figure 1:
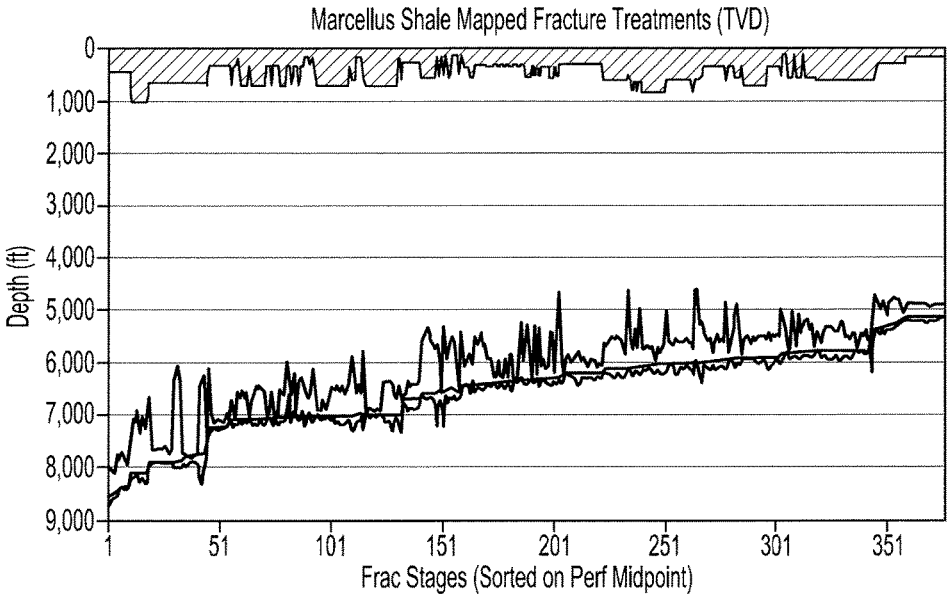
FIG. 1 shows the fracture extent in the vertical direction for hydraulic treatments in the Marcellus shale in the Appalachian Basin in Ohio, Pennsylvania, and West Virginia.
Figure 2:
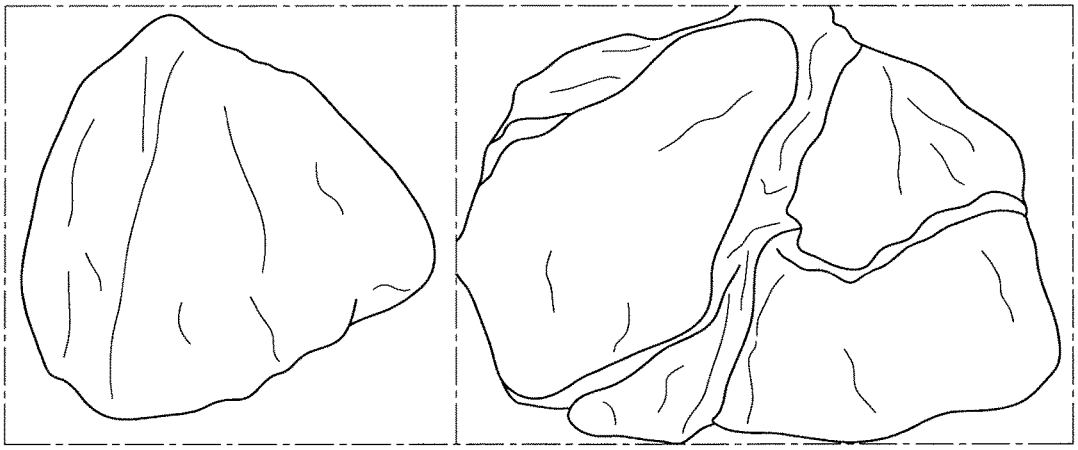
FIG. 2 is a large granite bolder fractured into many sections using plasma blasting with an arc-source.1 Left: Granite rock before plasma blasting. Right: Shattered granite rock after plasma blasting.
Figure 3:
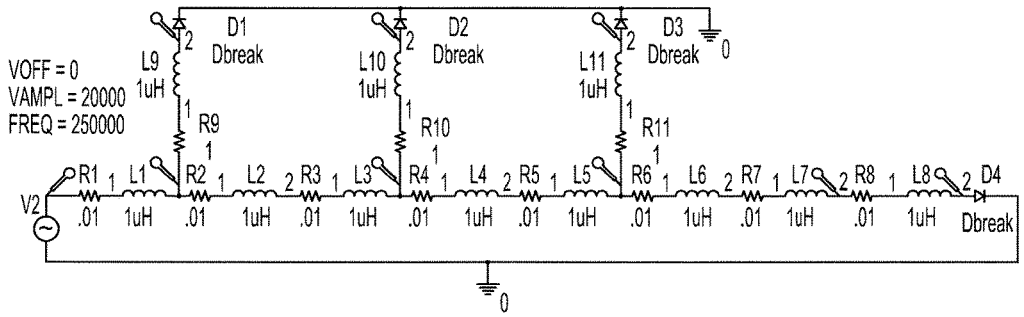
FIG. 3 is a circuit analog of small fractures extending from a larger principal fracture. Colored probes measure voltage differentials analogous to pressure differentials in FIG. 4 with corresponding colors.
Figure 4:
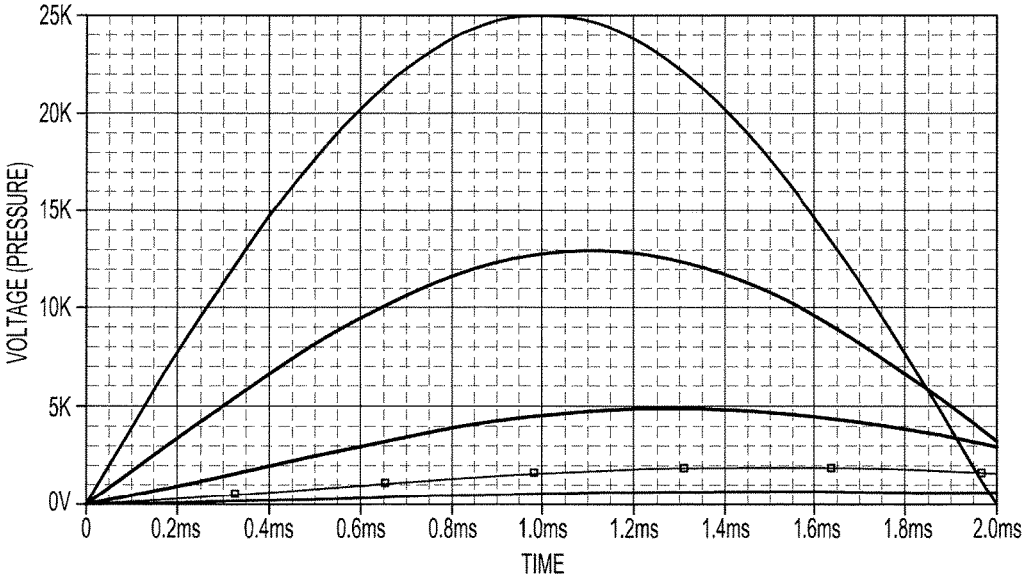
FIG. 4 is an electrical analog of pressure within fractures resulting from a transient pressure burst at the root of a principal fracture. Green: Voltage (pressure) burst at fracture root. Other colors are analogous to pressures within fracture branches at distances: Red—0.125 L, Blue—0.375 L, Yellow—0.625 L, Purple—end of fracture (1.0 L), where L is the length of the principal fracture.

Pulsed electric discharges have been utilized previously for generating very high pressures that can fracture rock at the surface or in shallow mines. For example, in FIG. 2, an electric discharge in water was used to fracture large granite boulders in a laboratory. Pulsed energies were less than about 30 kJ and pulse lengths were on the order of 100 microseconds. In one embodiment of the invention, at least sixty-seven times more energy can be used to fracture rock, yielding a far more powerful effect over a much larger volume of rock.

Arc Source

Figure 5:
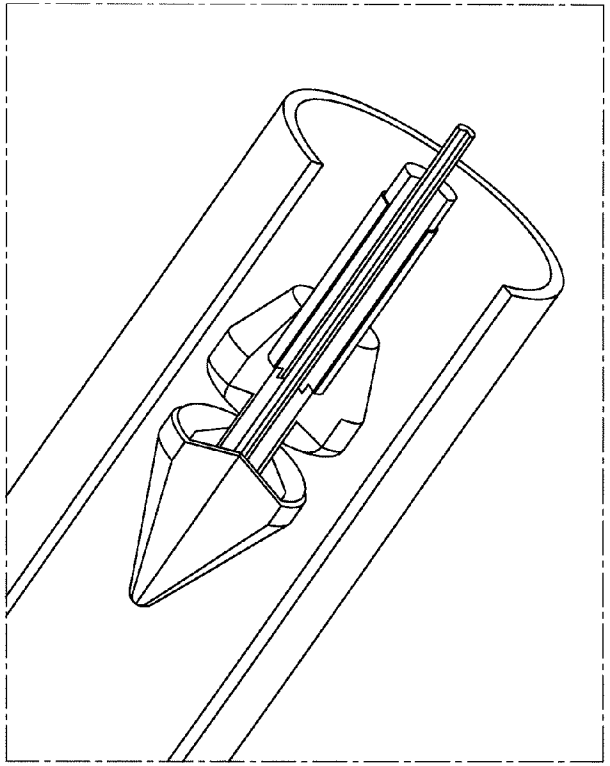
FIG. 5 is one embodiment of the arc-source for driving high-pressure impulses in hydrocarbon-bearing shale formations.

FIG. 5 shows one embodiment of an arc-source that can generate high pressure pulses in and around the wellbore. In this embodiment, the arc-source consists of a pair of electrodes (gold tori in FIG. 5) separated by a small gap where the electric discharge is initiated. The electrodes can be composed of tungsten in order to minimize electrode erosion and maximize heat tolerance. The electrodes can be backed by structural members that provide inertial cooling of the electrodes and help guide the tool down the wellbore. In the illustrated configuration, forces on the probe body will be mostly radial, minimizing the tendency for the probe to move along the wellbore during a shot. To limit mechanical shock to components attached to the arc-source, the system can be equipped with shock absorbing devices (not shown) that use spring tension, inertia, and water resistance to dampen impulses. With a short axial extent for the electric discharge, the arc-source can concentrate its discharge energy at an individual perforation in the wellbore. In doing so, conductance of the pressure surge into the formation will be maximized, enhancing the effectiveness of the electric discharge.

Figure 6:
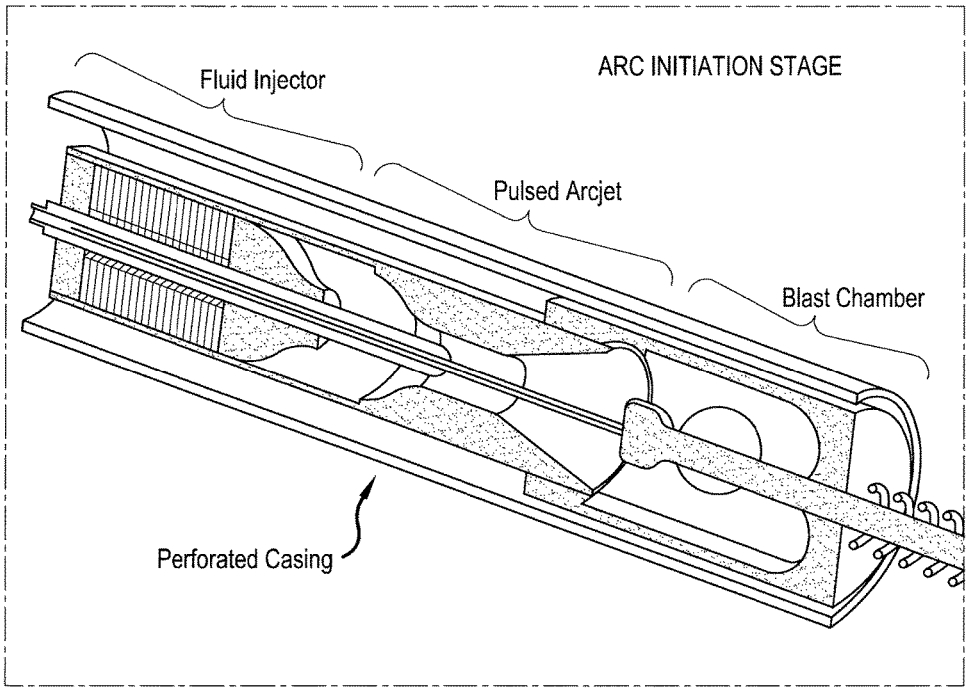
FIG. 6 is a cross-sectional view of a 3-D rendering of a preferred embodiment of an arc-source for the invention that includes callouts for major subassemblies including a fluid injector subassembly, a pulsed arcjet subassembly, and a blast chamber subassembly, all shown within a perforated casing that lines the wellbore.

FIG. 6 shows another embodiment of the arc-source, or arc-discharge device, for electro-fracturing around a wellbore. In this embodiment, the arc-source includes three subassemblies consisting of a fluid injector subassembly, a pulsed arcjet subassembly, and a blast chamber subassembly. For reference, the arc-source is shown in relation to a perforated casing that would line the wellbore and surround the arc-source in the wellbore. In addition to the arc-source shown in FIG. 6, the electro-fracturing system can include an electrical power supply located at the surface of the well and a power transmission line that transmits energy from the power supply at the surface to the arc-discharge device in the wellbore.

Figure 7:
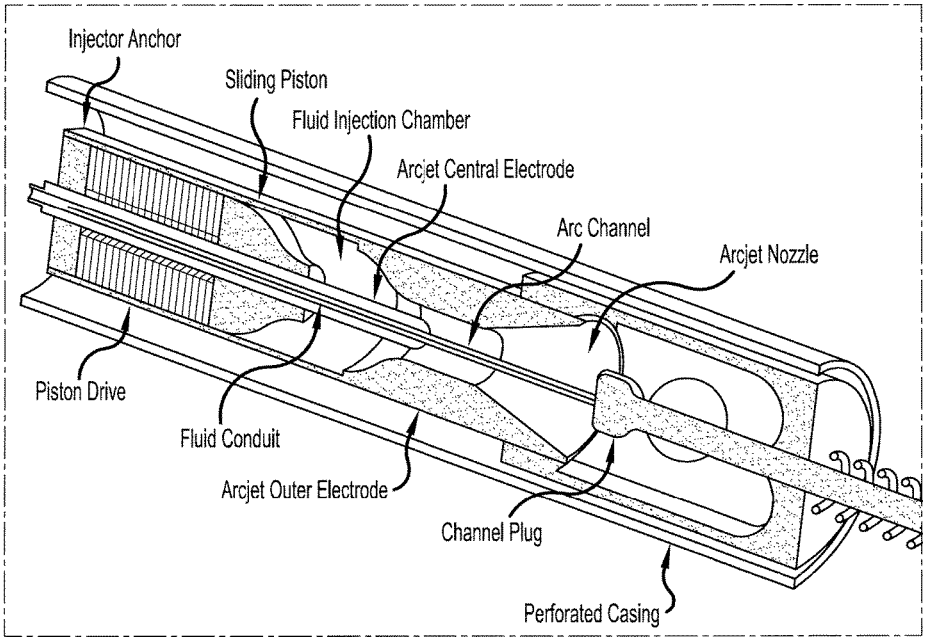
FIG. 7 is a cross-sectional view of a 3-D rendering of the preferred embodiment of the arc-source that includes further descriptive breakdown and callouts for specific components of the fluid injector subassembly and the pulsed arcjet subassembly referred to in FIG. 9.

Referring generally to FIG. 7, the pulsed arcjet subassembly can include an arcjet central electrode; an arcjet outer electrode; an arc channel; and an arcjet nozzle. Components of the fluid injector subassembly attached to the pulsed arcjet subassembly of the present embodiment include a fluid injection chamber; a fluid conduit; a sliding piston; a piston drive; and an injector anchor. Components of the blast chamber subassembly attached to the pulsed arcjet subassembly of the present embodiment include a channel plug. The channel plug can slide axially within the blast chamber subassembly.

Before each pulse, the channel plug is retracted into the arcjet nozzle by springs or the like in order to block fluid flow into the pulsed arcjet subassembly from fluids present in the wellbore. With the channel plug in this position, the fluid injection chamber within the electro-fracturing device is isolated from wellbore fluids. In this initial configuration, the fluid injection chamber can be filled with a pressurized fluid flowing inside of the fluid conduit from an external source of fluid. An opening is provided from the fluid conduit into the fluid injection chamber to allow fluid filling of the fluid injection chamber. During the filling operation and prior to a pulse, the sliding piston is pushed back and the piston drive elements are compressed against the injector anchor in preparation for energizing the piston drive during a pulse.

A fluid delivery means is included that may consist of a pressurized fluid storage tank containing fluid sufficient for one or more pulses. The tank may be connected to an inlet to the fluid conduit located behind the injector anchor. Alternatively, a tube from the surface may connected to the fluid conduit inlet to supply fluid from the surface. Means may also be provided for drawing in-situ fluids present in the wellbore into the fluid conduit inlet and from there into the fluid injection chamber. In-situ fluids may be filtered or processed before use to minimize possible degradation of the electro-fracturing device from particulates and undesirable chemical components.

Fluids may be comprised of a variety of materials including in-situ wellbore fluids, purified water, ammonia, supercritical carbon dioxide, and the like. A preferred fluid is ammonia with chemical formula NH3. Ammonia has been used successfully in many experimental arcjets. Decomposition products of ammonia consist of nitrogen and hydrogen primarily, which will leave no residue in the arcjet or in the well. With no residue in the well, there will be minimal interference with hydrocarbon flow after treatment of the well. In a preferred embodiment, ammonia is fed to the fluid conduit inlet as a pressurized fluid either from a pressurized storage tank in the wellbore close to the arc-discharge device or via a tube from the surface.

In one embodiment, means may be provided to heat and pressurize the ammonia so that the ammonia becomes a supercritical fluid. The critical point for ammonia occurs at a temperature of 132.4 deg. C. and a pressure of 11.28 MPa (1,636 psi). In-situ wellbore pressures can easily exceed the critical pressure for ammonia, and wellbore temperatures can exceed the critical temperature of ammonia in some wells, so that supercritical ammonia is easily formed and sustained in wellbore equipment. In some cases, a small amount of heat may need to be added to background heat in order to form supercritical ammonia. Above the critical point, ammonia begins to act like a gas in that it no longer wets surfaces as does a liquid, although it has a density similar to a liquid. Supercritical ammonia is then well-suited to high-speed flow through the pulsed arcjet subassembly and arc generation between electrodes during each pulse of energy.

At the beginning of each pulse of energy, the fluid supplied to the fluid injection chamber by the fluid delivery means is driven through the gap between the arcjet central electrode and the arcjet outer electrode and into the arc channel by a forward motion of the sliding piston pushed by the piston drive once it is energized. High-voltage is simultaneously applied between the arcjet central electrode and the arcjet outer electrode to form an arc discharge through the fluid in the space between the arcjet central electrode and the arcjet outer electrode. The solid walls surrounding the fluid conduit serve as the main body of the arcjet central electrode.

With a positive voltage polarity on the arcjet central electrode relative to the arcjet outer electrode, electrical current from a power supply at the surface flows along the fluid conduit to the arcjet central electrode and through the arc once the arc forms. Return current back to the surface flows through the arcjet outer electrode and the outer shell of the fluid injector. With this voltage polarity, ions in the arc impinge on the arcjet outer electrode and electrons impinge on the arcjet central electrode. Surface erosion from ion impingement occurs in the arcjet outer electrode while simple heating is produced in the arcjet central electrode from electron impingement.

In a preferred embodiment, the polarity is reversed so that the arcjet central electrode is negative relative the arcjet outer electrode. In this case, the current flow reverses and material erosion occurs primarily in the arcjet central electrode and very little erosion occurs in the arcjet outer electrode. The more complex and expensive arcjet outer electrode is thereby preserved and its useful lifetime extended. Erosion is confined to the arcjet central electrode where it can be more easily corrected by employing a consumable electrode that is inserted into the arc region as the electrode material erodes in the arc.

Typical erosion rates are 100-200 micrograms per Coulomb of charge transferred in common spark-gap switches. Using this erosion rate, and assuming 500 Coulombs of charge is transferred in each arc, approximately 0.05-0.1 grams of material will erode away on each pulse. An arcjet central electrode made of tungsten with a diameter of 2 cm, will then have to be fed into the arc at the rate of approximately 1.6 cm for every thousand shots.

During the arc discharge, fluid is injected into the arc at a selected fluid velocity and a selected pressure using the fluid injector subassembly attached to the pulsed arcjet subassembly. The selected fluid velocity and pressure are sufficient to drive the arc into and through the arc channel. The restricted flow within the arc channel forces most of the fluid to pass into the arc region and helps to mix the fluid and heat it uniformly. Selected shapes for the arc channel and arcjet nozzle cause the arc to terminate on the surface of the arcjet nozzle, where heat flux to the surface can be spread out along the expanding surface of the arcjet nozzle. In the preferred embodiment, the shape of arcjet nozzle is tapered with a selected taper angle.

A jet of hot fluid, much of which is in a plasma state, is emitted from the arcjet nozzle during an arc discharge. The channel plug is then driven to its fully extended position by the force of the initial jet of hot fluid ejected from the arcjet nozzle, allowing hot gases and plasma to enter the blast chamber. The jet of hot fluid is quickly thermalized outside of the pulsed arcjet subassembly, and pressure in the blast chamber rises rapidly. The blast chamber subassembly attached to the pulsed arcjet subassembly directs the hot fluids radially outward through any perforations in the wellbore casing and into the rock formation around the wellbore. The pressurized fluid then expands into the formation outside the wellbore causing the rock to fracture. The length of the blast chamber along the wellbore axis may be selected to provide blast pressure over a pre-determined length of the wellbore.

Pulsed Power Supply

The pulsed power supply can be located at the surface of the well. Since size and weight are not issues at the surface of the well, energy equivalent to GPF methods can easily be applied. In fact, energy far in excess of GPF methods can be applied if desired. Special engineering measures can be taken to protect the wellbore casing as the pulse energy exceeds typical GPF energies. Power is transmitted from the pulsed power supply to the arc-source deep within the well along a power transmission cable, typically a coaxial transmission cable. Based upon GPF results and previous plasma rock fracturing tests, pulse energies of two megajoules should produce extensive rock fracturing around the wellbore without damaging the wellbore casing. For reference, two megajoules equals the energy in one pound of TNT. This energy is about sixty-seven times the energy applied in the granite fracturing tests shown in FIG. 2. Assuming system efficiencies of 80%, approximately 2.5 MJ of energy would be required at the pulsed power source at the surface of the well.

Figure 8:
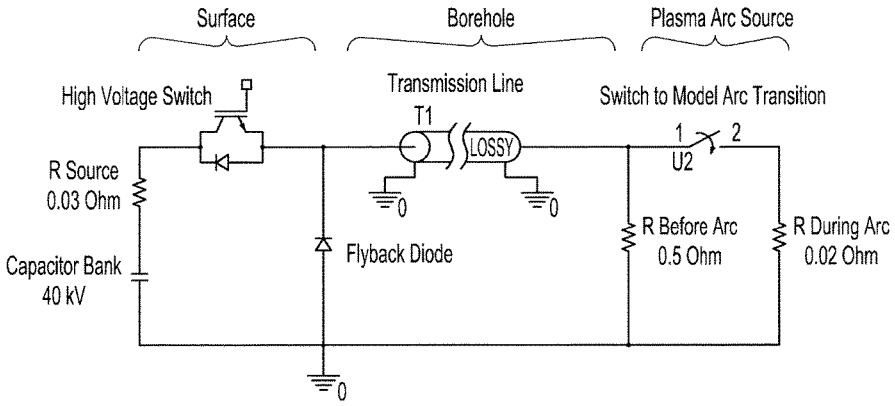
FIG. 8 is an overall circuit topology for the pulsed power system of one embodiment.

FIG. 8 shows a schematic diagram for the overall circuit, including the pulsed power supply at the surface of the well, the power transmission line along the length of the wellbore, and the arc-source at depth within the well. This circuit is well suited to electro-fracturing in which the impedance of the load changes abruptly when the arc forms in the discharge device. In addition, there is no reversal of the capacitor bank voltage, which will lead to substantially increased capacitor lifetimes.

Figure 9:
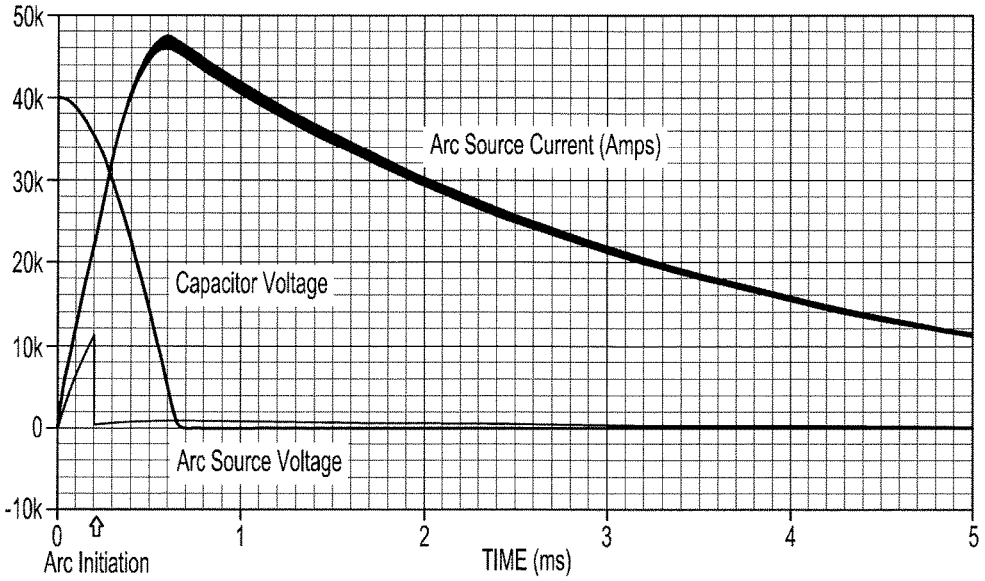
FIG. 9 is a single-pulse waveform generated by the circuit in FIG. 6 using a moderately sized cap bank.
Figure 10:
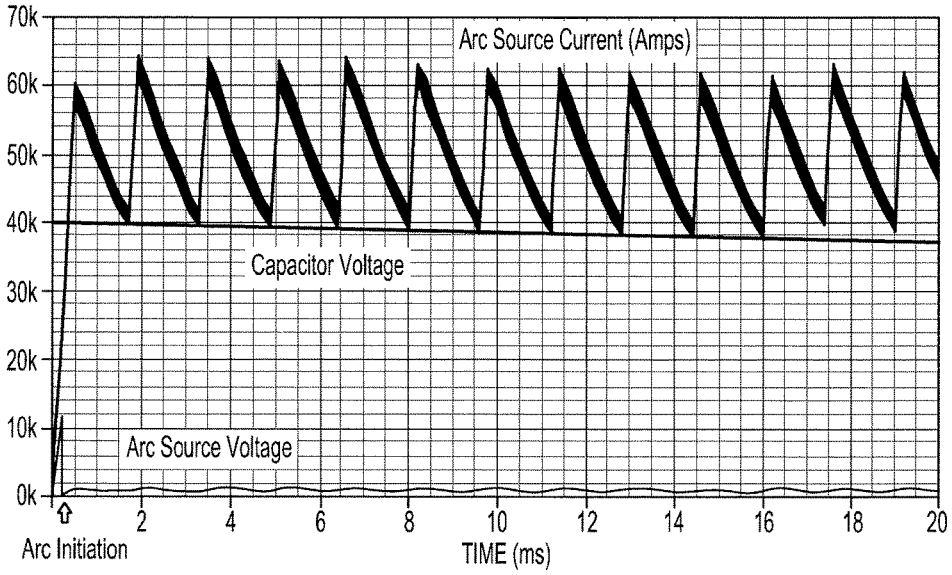
FIG. 10 shows pulsed waveforms with cyclic discharge of a large capacitor bank to create extended pulse duration.

Waveforms produced at the arc source for a relatively small capacitor bank and short pulse duration are shown in FIG. 9. A coaxial cable length of 2000 meters is assumed for the transmission line modeled in FIG. 8 to accurately capture electrical effects that will occur in a deep well. In operation, the high voltage switch remains closed until the capacitor bank is completely discharged. At the zero-voltage crossing of the capacitor bank, diode Dl becomes forward biased so that current flow from the inductances is diverted to the loop around the diode and inductors, and damaging voltage transients are avoided. If a much larger capacitor bank is used, the pulsed power supply may be operated in a mode in which the high-voltage switch is cycled on and off repeatedly during a specified pulse period in order to achieve a variable pulse length from the superposition of multiple short pulses. FIG. 10 shows an example of this type of operation for the circuit topology in FIG. 8.

The time required to form the initial fracture network over an entire well is ultimately determined by the power available for charging the capacitor bank and the length of the stimulation zone. Mobile generators up to about two megawatts are readily available commercially. Assuming 90% efficiency in the capacitor charging equipment at 2 MW, the capacitor bank could be charged from zero to 2.5 MJ in about 1.4 seconds. With this pulse repetition rate, and the assumption that five pulses are applied at each location in the wellbore on top of several thousand psi of bias pressure, a well could be pretreated at the rate of 8.6 ft. per minute if the treatment intervals are one foot apart. Initial pulsed fracturing for 5000 ft. of wellbore would then require less than ten hours. The completion rate would be faster if fewer pulses were effective at each perforation, or if more power was used in the operation. Total energy consumed in the initial fracture formation would be about 20,000 kW-hrs. This is roughly the energy contained in natural gas output from a typical gas well producing 2000 Mcf/day over a two day period. Energy consumed in practice of the invention is clearly negligible on the scale of the energy content produced by a single gas well.

What is claimed is:

1. A method for fracturing a subterranean geological formation, comprising:

establishing a substantially static fluid pressure in a well in the geological formation, wherein the substantially static pressure is less than a threshold pressure that fractures the geological formation; and generating a pressure pulse in the well such that the pressure pulse combined with the substantially static pressure forms a plurality of fractures in the geological formation; wherein the pressure pulse is generated with an electric arc means, and further wherein the electric arc means forms an electric arc in an arc jet.

2. The method of claim 1, further comprising generating the pressure pulse in superposition with the static pressure more than once during a pre-selected time period within the well.

3. The method of claim 2, wherein the pressure pulses are generated in various treatment zones along the well.

4. The method of claim 1, wherein the geological formation is a hydrocarbon-bearing geological formation.

5. The method of claim 1, wherein the well is a geothermal well or an injection well.

6. The method of claim 1, wherein the electric arc means comprises an electrical transmission line for transmitting electrical energy generated outside the well to a selected location within the well.

7. The method of claim 1, wherein the electric arc means comprises a pulsed electrical power supply located outside of the well for supplying electrical energy to initiate and sustain the electric arc.

8. The method of claim 7, wherein the pulsed electrical power supply comprises a capacitor bank to store energy for sustaining the electric arc.

9. The method of claim 7, wherein the pulsed electrical power supply comprises a compulsator to generate pulsed energy for sustaining said electric arc.

10. The method of claim 7, wherein the pulsed electrical power supply comprises a flywheel-energy-storage-means for supplying energy to sustain the electric arc.

11. The method of claim 1, further comprising injecting a fluid into the electric arc of the arc jet to replenish material that has been heated and subsequently expelled from a channel in the arc jet.

12. The method of claim 11, wherein the fluid is ammonia.

13. The method of claim 11, wherein the arc jet includes means for directing the movement of the fluid that is heated by the electric arc radially outward from the well and into the geological formation.

14. The method of claim 1, wherein the pressure pulse is generated by an exothermic-chemical-reaction-means.

15. A method for fracturing a subterranean geological formation, comprising:

establishing a sub-threshold substantially static fluid pressure in a well in the geological formation;

generating a pressure pulse in the well such that the pressure pulse combined with the substantially static pressure forms a plurality of fractures in the geological formation, wherein the pressure pulse is generated by an arc jet.

16. An apparatus for fracturing a subterranean geological formation from a passage extending through the geological formation, comprising:

an arc jet insertable into the passage and having an electric arc channel, wherein the arc channel contains a fluid;

a pulsed electrical power supply in communication with the arc jet; and means for transmitting electrical energy from the pulsed electrical power supply to the arc jet, wherein the pulsed electrical power supply transmits electrical energy to the arc jet to generate an electric arc in the fluid in the arc channel thereby generating a pressure pulse for generating a plurality of fractures in the geological formation.

* * * * *